United States Patent [19]

Kersker, Michael M. et al.

[11] Patent Number: 4,681,736

[45] Date of Patent: Jul. 21, 1987

[54] ALUMINUM ALLOY

[75] Inventors: Michael M. Kersker, Beverly, Mass.; William G. Truckner, Avonmore, Pa.; Douglas A. Granger, Murrysville, Pa.; Elwin L. Rooy, Franklin Park Borough, Pa.

[73] Assignee: Aluminum Company of America, Pittsburgh, Pa.

[21] Appl. No.: 679,550

[22] Filed: Dec. 7, 1984

[51] Int. Cl.[4] ..... C22C 21/02

[52] U.S. Cl. ..... 420/535; 148/438; 148/439; 420/537

[58] Field of Search ..... 420/534, 535, 537, 538; 148/3, 13, 438, 439

[56] References Cited

PUBLICATIONS

Saikin, V. T., "Casting Alloy of the Al—Si—Cu—Ni System", *Metal Science and Heat Treatment,* vol. 19, Nos. 9-10, 1977, pp. 804-807.

Hanafee, J. E., "Effect of Nickel on Hot Hardness of Aluminum-Silicon Alloys", *Modern Castings,* Oct. 1963, pp. 514-520.

Registration Record of Aluminum Association Alloy Designations and Chemical Composition Limits for Aluminum Alloys in the Form of Castings and Ingot, The Aluminum Association, Jan. 1984, pp. 1-8

*Primary Examiner*—R. Dean

*Attorney, Agent, or Firm*—Daniel A. Sullivan, Jr.

[57] ABSTRACT

An aluminum alloy consisting essentially of about the following percentages of materials:

Si=14 to 18
Fe=0.4 to 2
Cu=4 to 6
Mg=up to 1
Ni=4.5 to 10
P=0.001 to 0.1 (recovered)

remainder grain refiner, Al and incidental impurities.

7 Claims, 12 Drawing Figures

S# 505319 -- 16 SI - 0.6 FE - 4.8 CU - 5.7 NI -- 500 X
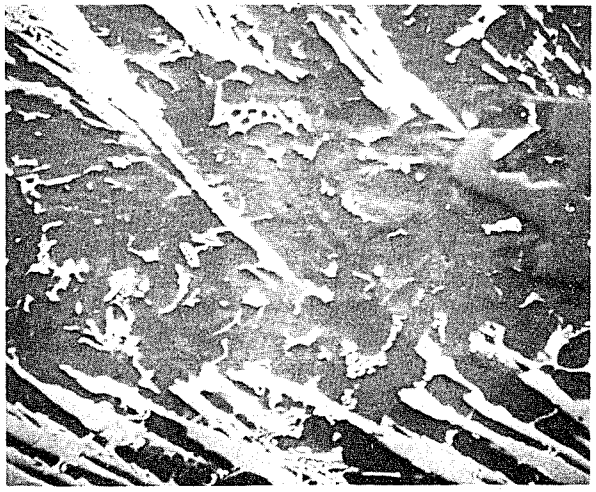
Fig. 2a BACKSCATTERED ELECTRONS

S# 505319 -- 16 SI - 0.6 FE - 4.8 CU - 5.7 NI -- 500 X

SILICON

NICKEL

IRON

COPPER

S# 505318 - - 16 SI - 0.6 FE - 4.8 CU - 0.60 MG - 5.2 NI - - 500 X

MAGNESIUM

BACKSCATTERED ELECTRONS

S# 505318 - - 16 SI - 0.6 FE - 4.8 CU - 0.60 MG - 5.2 NI - - 500 X

SILICON

NICKEL

IRON

COPPER

ALUMINUM ALLOY

SUMMARY OF THE INVENTION

It is an object of the invention to provide a new aluminum alloy.

This as well as other objects which will become apparent from the discussion that follows are achieved, according to the present invention, by providing, aluminum alloy consisting essentially of about the following percentages of materials:

Si=14 to 18
Fe=0.4 to 2
Cu=4 to 6
Mg=up to 1
Ni=4.5 to 10
P=0.001 to 0.1 (recovered)

remainder grain refiner, Al and incidental impurities.

Compositions herein are given in percentages by weight, unless noted otherwise.

DESCRIPTION OF THE PREFERRED EMBODIMENTS

Figure 1:
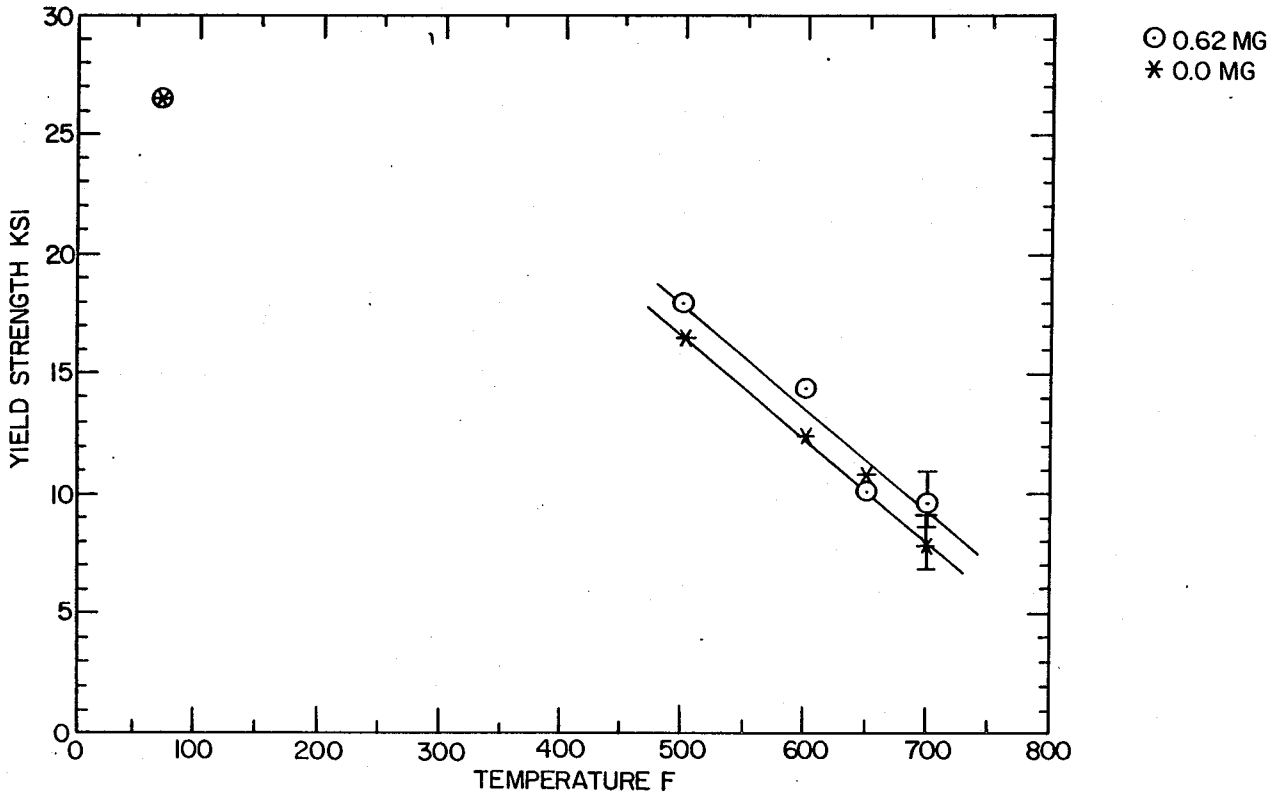
FIG. 1 is a graph of yield strength versus temperature (tested at temperature) for Al-16Si-5Cu-5Ni-0.5Fe Alloys, 1000 hours at temperature.
Figure 2B:
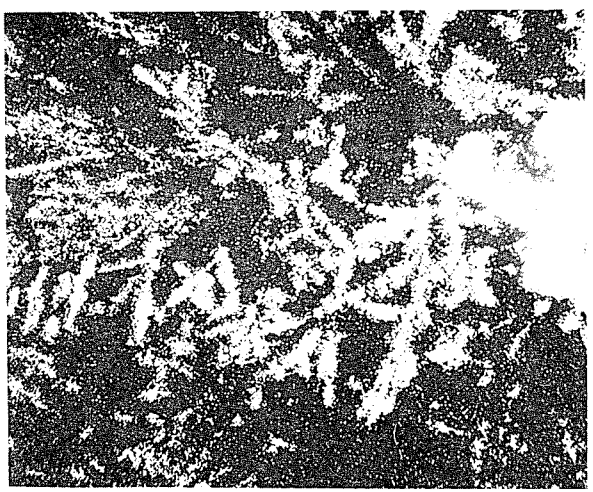
FIGS. 2 and 3 are photomicrographs, composed of FIGS. 2*a* and 3*a*, respectively showing an electron scanning micrograph of a particular area and then individual, corresponding X-ray maps, respectively, FIGS. 2*b* to 2*e* and 3*b* to 3*f* for each of the elemental constituents, Si, Ni, Fe, Cu, and Mg.
Figure 2E:
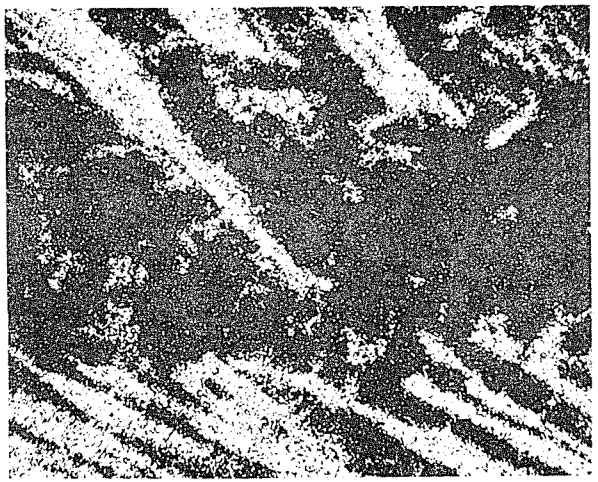
Figure 2D:
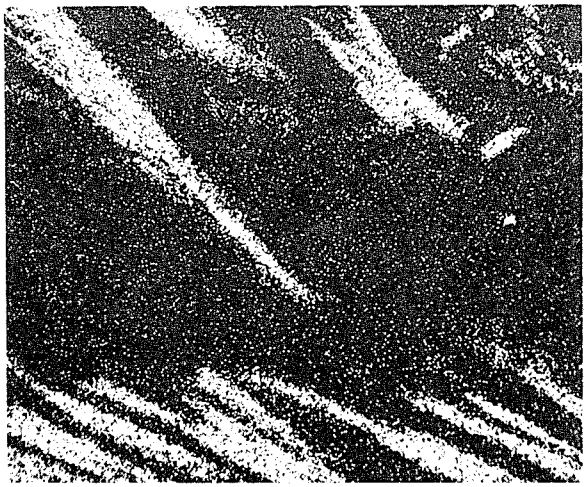
Figure 2C:
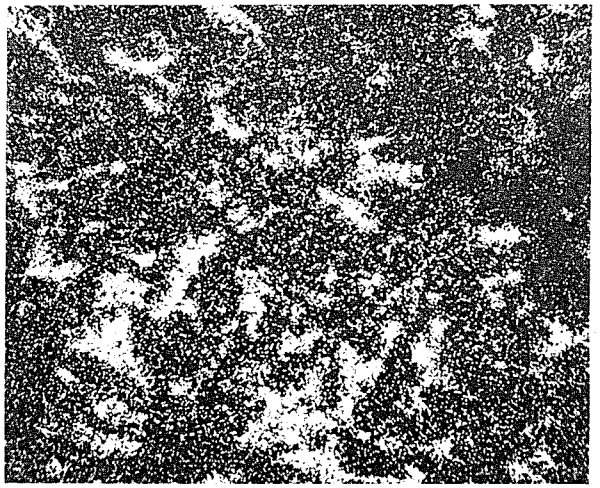
Figure 3F:
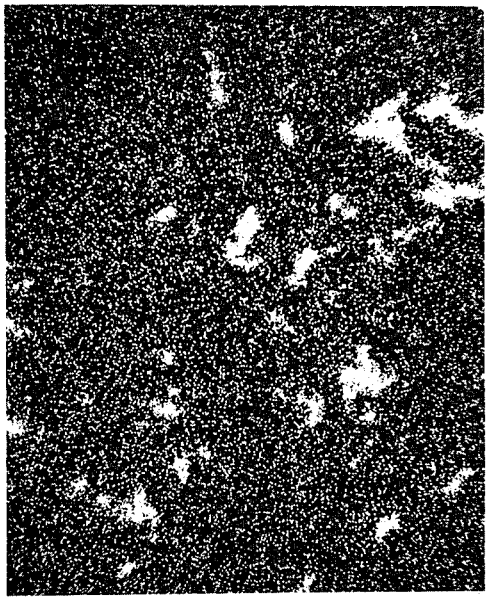
Figure 3A:
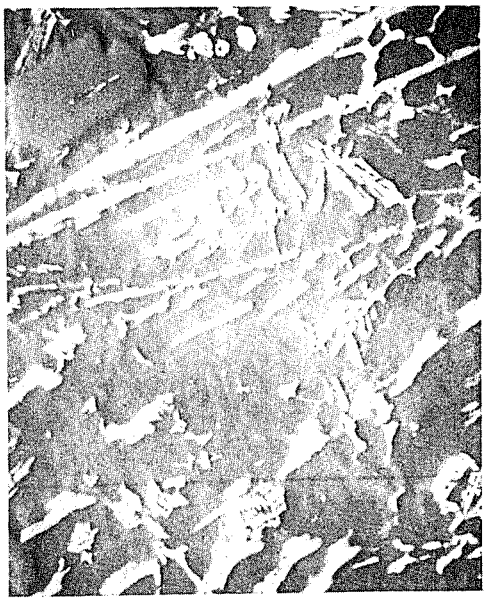
Figure 3B:
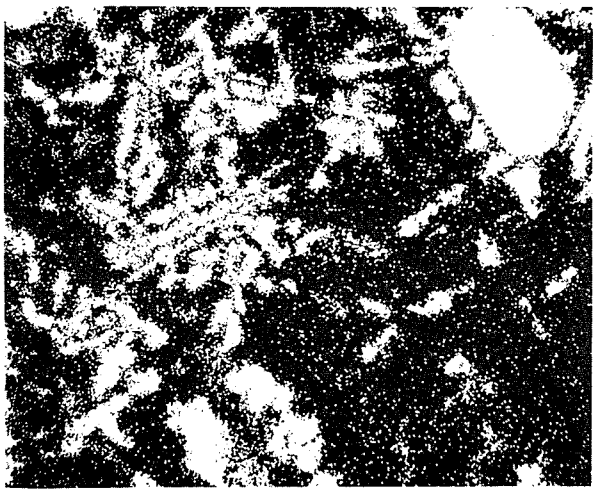
Figure 3C:
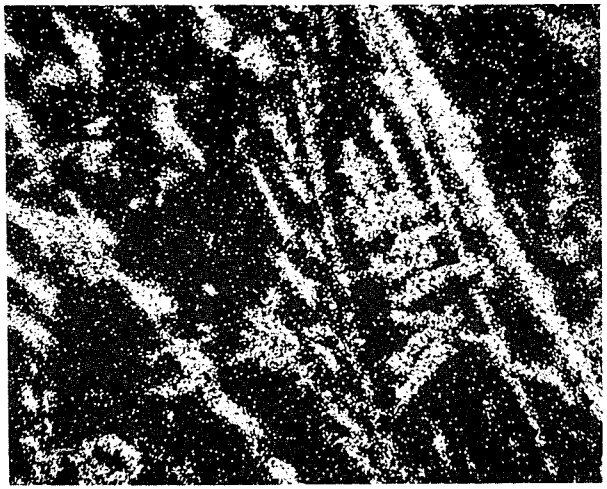
Figure 3D:
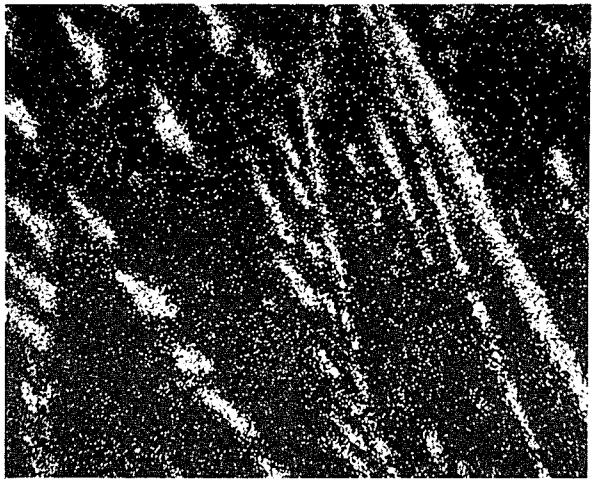
Figure 3E:
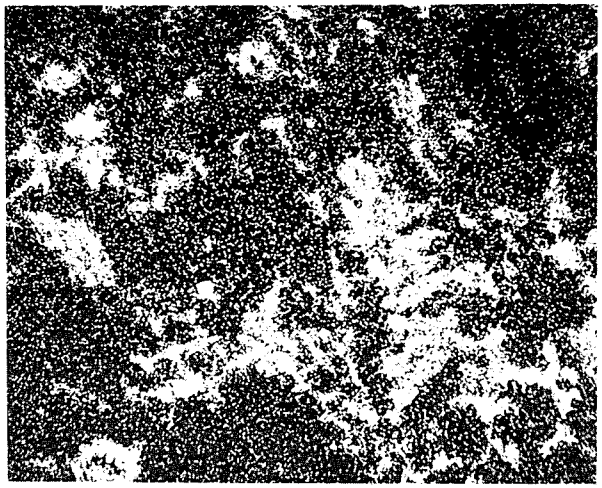

The alloy of the invention is marked by an ability to perform in cast form at high temperature. One application is cast pistons for internal combustion engines, especially high specific output engines, where engine operating temperatures are higher than usual.

Other applications where the alloy can be put to use are for engine blocks, cylinder heads, compressor bodies, and any others where service under high temperature is specified. The alloy can give particularly good service in high temperature diesel engines.

The alloy contains silicon in hypereutectic quantities. This causes the presence of silicon particles in the cast alloy and contributes to wear resistance.

As noted above, the alloy of the invention generally falls within the following composition limits:

Si=14 to 18
Fe=0.4 to 2
Cu=4 to 6
Mg=up to 1
Ni=4.5 to 10
P=0.001 to 0.025 (recovered)

remainder grain refiner, Al and incidental impurities.

In general, silicon below 14% is not desired, since then there is no significant fraction of primary silicon for wear resistance. Silicon in excess of 18% leads to decreased ductility and inferior casting results. Silicon content of approximately 14 to 18% provides good fluidity for casting.

The presence of Fe, Ni and Cu provides AlFeNiCu or AlFeNi secondary phase which is highly stable and contributes to elevated temperature strength.

Higher contents of Fe provide a means of minimizing die sticking in die casting applications.

Mg contributes to high strength at elevated temperature, as compared to the same composition without Mg.

Nickel leads to the formation of nickel aluminide and contributes to high temperature strength. The metastable form, $Al_3Ni_2$, occurs first. After 1000 hours at 650° and 700° F., the stable $Al_3Ni$ begins to form.

Phosphorus is present to form aluminum phosphide ($Al_3P$) particles, which act as nuclei for the primary Si phase, the first phase to form upon cooling of the cast alloy. This leads to primary Si particles of reduced size, of a more globular, less angular shape. The highly acicular primary Si idiomorph is avoided. Improved castability, in terms of flowability and fluidity, is achieved, and the final casting is more ductile.

As noted, the P compositional ranges refer to *recovered* P. Higher quantities of P may be supplied in the alloy sent to the end user, due to the propensity of P to be lost by oxidation.

The presence of grain refiner provides several advantages. The alloy is more castable. Resistance to hot cracking is increased. In addition to these benefits, the cast alloy has greater ductility.

A preferred percentage composition range is:

Si=15.5 to 16.5
Fe=0.55 to 0.65
Cu=4.7 to 5.3
Mg=up to 0.65
Ni=5.2 to 5.8
Ti=0.03 to 0.05
P=0.005 to 0.015 (recovered)

According to a variant of the invention, magnesium is required, in the range

Mg=0.55 to 0.65.

The presence of magnesium provides Q-phase in the casting. Q-phase is Al-Si-Cu-Mg phase formed during solidification. For further information on Q phase, see *Aluminum Alloys: Structure and Properties* by L. F. Mondolfo, Butterworth & Co. Publishers Ltd., London, England, 1976, pages 644–651. It can be a metastable phase in dilute alloys, but with this composition it is stable. The size of the particles is approximately 2–3 microns. It is thought to have the effect of providing elevated temperature strength and creep resistance.

Mg in excess of 0.65% Mg should be avoided, since its oxidation tendencies are increased. Oxidation may lead to inclusions which reduce mechanical properties and machinability. MgO dispersal is another possibility, which may aggravate the occurrence of hydrogen porosity. Breakaway oxidation may also result, in which amorphous aluminum-magnesium oxide becomes crystalline aluminum-magnesium oxide, thus leading to a deterioration in mechanical properties and machinability.

In testing, both alloys with Mg and those without showed excellent elevated temperature strengths after 1000 hours at temperature from 500° to 700° F. The Mg-containing alloy displayed a 2 ksi advantage in strength over the Mg-free alloy, while both alloys were superior to other compositions in common use for elevated temperature applications.

Ti is present as a grain refiner and should be present in the above. In the case of alloy for use in foundries where the metal is held molten for extended periods, it may be beneficial to provide periodic additions of from 0.01 to 0.025% Ti in order to maintain effective grain refinement.

Boron will typically be present in conjunction with the titanium, particularly where the alloy has been manufactured using a titanium-boron master alloy to inoculate the alloy of the invention with grain refiner.

Certain impurity elements in the alloy must be minimized. For example, Na, Ca and Sb, react with P, rendering the P ineffective for Si primary phase refinement. These elements each have limit of 0.001 maximum. Unless noted otherwise, impurity limits are:

Others each=0.05 maximum

Others total=0.15 maximum

The alloy of the invention can be made for supply to users in the form of ingot. Alternatively, it can be supplied in molten form. It can be cast by founders in sand, permanent molds, or by die casting, using conventional methods.

The alloy can be used "as cast" or in a heat treated condition. Since the alloy by its nature is resistant to change at elevated temperatures, heat treatments such as artificial aging are not preferred. However, a T5 heat treatment for stress relief is helpful to provide dimensional stability and improved machinability. A T5 temper is achieved by heating the "as cast" product for 6 to 12 hours in the range 400° to 500° F.; a preferred T5 temper is "as cast" plus 8 hours at 450° F. Hardness in the T5 condition at room temperature is approximately 66–67 $R_B$, which is equivalent to approximately 120 BHN.

The alloy of the invention, besides being a casting alloy, is also suitable for use in powder form for powder metallurgy.

From the point of view of microstructure, the cast alloy of the invention has generally a hypereutectic-type structure, with relatively large primary silicon particle in a eutectic aluminum-silicon matrix. As noted above, particles of $Al_3Ni_2$ (Card 14-648) are present, these beginning to transform to $Al_2Ni$ (Card 2-0416) with increasing time at elevated temperature. Reference is to the X-ray diffraction pattern cards of the Joint Committee on Powder Diffraction Standards, Swarthmore, Pa. Also present is a phase thought to be $(FeNiCu)Al_9$ or $(FeNi)Al_9$ with a diffraction pattern like that of Card 30-7 for $Al_9Co_2$. Due to the extensive amount of diffraction lines in $Al_3Ni_2$ and the $FeNiAl_9$ type patterns, it could not be determined if either $CuAl_2$ or Ni was present because of superimposition.

Illustrated of the microstructure are FIGS. 2 and 3, which each include an electron scanning micrograph in the Figures "a" plus the corresponding microprobe X-ray maps for the different elemental constituents. The maps show the following element combinations:

505318—Pure Si, Ni-Fe-Al, Cu-Ni-Al, Cu-Al, Cu-Mg-Si-Al

505319—Pure Si, Ni-Fe-Al, Cu-Ni-Al, Cu-Al,

Only the Ni-Fe-Al phase which appeared as large needles was suitable for quantitative analysis. Average analyses of four of these particles for each alloy type are in the following Table.

| | Atomic % | | | | | |
|---|---|---|---|---|---|---|
| | Al | Fe | Ni | Si | Cu | Mg |
| 505318 | 79.2 | 2.6 | 15.7 | 1.2 | 1.0 | .2 |
| 505319 | 79.7 | 2.9 | 15.2 | 1.3 | .8 | .0 |

FIGS. 2 and 3 are for castings in the T5 temper (8 hours at 450° F.). Holding the alloy at elevated temperature, e.g. 1000 hours at 700° F., operates to make the microstructure less acicular, as compared to FIGS. 2 and 3.

Table I lists the mechanical properties of the alloys at room temperature and at temperature, after 1000 hours exposure to such temperature. FIG. 1 shows the yield strength as a function of temperature. These data indicated that the trend for high temperature stability continues up to 700° F. Yield strengths between 8 and 10 ksi were achieved with Mg-containing alloy still maintaining an approximate 2 ksi advantage over the Mg-free alloy. For comparison, wrought alloy 2219, long-recognized as a superior elevated temperature alloy, displays a yield strength of 3.5 ksi at 700° F. Also casting alloys 242, 332 and 336, the most commonly used elevated temperature casting alloys, all have yield strengths of about 3.5 ksi at 700° F.

TABLE I

MECHANICAL PROPERTIES OF EXPERIMENTAL CASTING ALLOYS

| | | Room Temperature | | | 1000 Hrs at 500° F. | | | 1000 Hrs at 600° F. | | | 1000 Hrs at 650° F. | | | 1000 Hrs at 700° F. | | |
|---|---|---|---|---|---|---|---|---|---|---|---|---|---|---|---|---|
| | | T.S., ksi | Y.S., ksi | % El. | T.S., ksi | Y.S., ksi | % El. | T.S., ksi | Y.S., ksi | % El. | T.S., ksi | Y.S., ksi | % El. | T.S., ksi | Y.S., ksi | % El. |
| S-505318 | | 34.0 | (1) | — | 20.9 | — | 1.0 | 18.2 | 14.8 | 1.0 | 12.3 | 9.6 | 0.50 | 15.4 | 11.3 | .50 |
| | | 29.2 | — | — | 22.3 | 17.4 | 1.0 | 17.7 | 13.7 | 1.0 | 13.9 | 10.3 | 0.50 | 12.0 | 9.1 | 1.0 |
| | | | | | 18.2 | 18.4 | 1.0 | 18.2 | 14.7 | 1.0 | 13.8 | 10.5 | 0.50 | 12.2 | 8.6 | 1.0 |
| | AVG. | 31.6 | | | 20.7 | 17.9 | 1.0 | 18.0 | 14.4 | 1.0 | 13.3 | 10.1 | 0.50 | 13.2 | 9.6 | 0.83 |
| S-505319 | | 28.5 | — | — | 21.1 | 16.0 | 0.5 | 15.6 | 12.0 | 1.0 | 14.1 | 10.6 | 0.50 | 9.7 | 7.2 | 5.1 |
| | | 31.3 | 26.5 | — | 22.9 | 17.9 | 1.0 | 15.9 | 12.9 | 2.0 | 13.7 | 11.0 | 0.50 | 13.7 | 9.4 | 1.5 |
| | | | | | 20.2 | 15.7 | 0.5 | 15.8 | 12.3 | 1.0 | 12.4 | 10.9 | 0.50 | 8.1 | 6.8 | 4.6 |
| | AVG. | 29.9 | 26.5 | | 21.4 | 16.5 | 0.67 | 15.8 | 12.4 | 1.3 | 13.4 | 10.8 | 0.50 | 10.5 | 7.8 | 3.7 |

NOTES:

(1) Value could not be measured.

(2) T5 temper - as-cast + 8 hours at 450° F.

(3) Permanent mold tensile bars - gage length machined to ¼" diameter.

| | Si | Fe | Cu | Mg | Ni | Ti |
|---|---|---|---|---|---|---|
| S-505318 | 15.6 | 0.62 | 4.8 | 0.62 | 5.2 | .04 |
| S-505319 | 16.1 | 0.57 | 4.8 | 0.00 | 5.7 | .04 |

While the invention has been described in terms of preferred embodiments, the claims appended hereto are intended to encompass all embodiments which fall within the spirit of the invention.

What is claimed is:

1. An aluminum alloy consisting essentially of about the following percentages of materials:

Si=15.5 to 16.5

Fe=0.55 to 0.65

Cu=4.7 to 5.3

Mg=up to 0.65

Ni=5.2 to 5.8

Ti=0.03 to 0.05

P=0.005 to 0.015 (recovered)
remainder Al and incidental impurities.

2. An aluminum alloy as claimed in claim 1 further containing about the following percentage of Mg:

Mg=0.55 to 0.65.

3. An aluminum alloy as claimed in claim 1 wherein the elements Na, Ca and Sb as incidental impurities are each below 0.001.

4. An aluminum alloy as claimed in claim 1 in the T5 condition.

5. A piston formed of an alloy as claimed in claim 1.

6. In an internal combustion engine, a piston formed of an alloy as claimed in claim 1.

7. An aluminum alloy as claimed in claim 1 wherein the incidental elements include boron as grain refiner.

* * * * *

UNITED STATES PATENT AND TRADEMARK OFFICE

CERTIFICATE OF CORRECTION

PATENT NO. : 4,681,736

DATED : July 21, 1987

INVENTOR(S) : Michael M. Kersker et al

It is certified that error appears in the above-identified patent and that said Letters Patent is hereby corrected as shown below:

Col. 3, line 33 Change "particle" to --particles--.

Col. 3, line 35 Change "$Al_2Ni$" to --$Al_3Ni$--.

Col. 3, line 66 Change "Illustrated" to --Illustrative--.

Col. 4, lines 25-26 Change "indicated" to --indicate--.

Signed and Sealed this

Fifth Day of January, 1988

*Attest:*

DONALD J. QUIGG

*Attesting Officer*

*Commissioner of Patents and Trademarks*